US005638971A

United States Patent [19]

Justesen

[11] Patent Number: 5,638,971

[45] Date of Patent: Jun. 17, 1997

[54] VACUUM SEAL CONTAINER

[76] Inventor: Jeffrey L. Justesen, 219 Woodland Ave., Bloomfield, Conn. 06002

[21] Appl. No.: 554,676

[22] Filed: Nov. 7, 1995

[51] Int. Cl.[6] ..... B65D 51/16; B65D 55/00

[52] U.S. Cl. ..... 215/228; 215/262; 215/270; 215/318; 215/320; 215/321; 215/343; 215/354; 215/381; 220/212; 220/231; 220/240; 141/65

[58] Field of Search ..... 215/228, 262, 215/270, 318, 320, 321, 343, 346, 354, 381; 220/212, 231, 240, 366.1; 141/25, 26, 27, 28, 64, 65, 69, 95

[56] References Cited

U.S. PATENT DOCUMENTS

| | | | |
|---|---|---|---|
| 761,408 | 1/1904 | Du Bois . | |
| 829,981 | 9/1906 | Lorenz . | |
| 889,531 | 6/1908 | Lorenz . | |
| 922,240 | 5/1909 | Barranger . | |
| 3,910,444 | 10/1975 | Foster | 215/318 X |
| 4,116,352 | 9/1978 | Davis . | |
| 4,580,692 | 4/1986 | La Barge et al. . | |
| 4,674,642 | 6/1987 | Towns et al. . | |
| 5,230,438 | 7/1993 | Kind et al. . | |
| 5,384,096 | 1/1995 | Burns | 215/321 X |
| 5,390,809 | 2/1995 | Lin . | |
| 5,405,038 | 4/1995 | Chuang . | |
| 5,406,992 | 4/1995 | Miramon | 141/65 |
| 5,469,979 | 11/1995 | Chiou | 215/228 |
| 5,546,997 | 8/1996 | Miramon | 141/65 |
| 5,558,243 | 9/1996 | Chu | 220/212 |
| 5,564,480 | 10/1996 | Chen | 141/65 |
| 5,564,581 | 10/1996 | Lin | 215/228 |

*Primary Examiner*—Stephen K. Cronin
*Attorney, Agent, or Firm*—McCormick, Paulding & Huber

[57] ABSTRACT

A vacuum seal container comprises a cylindrical container body having a peripheral seal extending therearound and a lid including an outer skirt for engaging the seal. The skirt defines an access port for communication with a vacuum-generating source. The lid further includes seating nodes which seat the lid in a raised position to form an interior air passageway for air evacuation. At reaching a threshold pressure difference between the inside and outside of the container, the seating nodes and the sidewall deform to lower the lid which blocks the interior air passageway to form a vacuum seal.

9 Claims, 2 Drawing Sheets

VACUUM SEAL CONTAINER

FIELD OF THE INVENTION

The present invention relates to containers, and more particularly to vacuum seal containers.

BACKGROUND INFORMATION

Vacuum containers are used routinely for protecting contents from the surrounding atmosphere. In order to create a vacuum, prior containers typically employ multiple and complex devices, and often require twisting movement of hard parts on ring seals which can distort the seals, thus making the seals prone to failure at the beginning of the sealing process.

It is an object of the present invention to overcome the drawbacks and disadvantages of prior vacuum seal containers.

SUMMARY OF THE INVENTION

The present invention is directed to a vacuum seal container which becomes self-sealing when a sufficient vacuum has been established. The container comprises a container body defining an outer body surface. A peripheral or primary seal is supported on the outer surface of the container body. A lid includes a downwardly depending skirt having an inner skirt surface for engaging the peripheral seal. The inner skirt surface is to oppose and to be spaced slightly outwardly from the outer body surface to form a space therebetween for air evacuation. The skirt further defines an access port for externally communicating with a means for evacuating air from the interior of the container body. Means for seating the lid on the container body in a raised or lowered position is provided such that the access port is positioned above the peripheral seal when the pressure difference between the interior and exterior of the container is below a threshold level. As such, the access port and the space between the outer body surface and the inner skirt surface form an interior air passageway for evacuating air from within. When the pressure difference reaches the threshold level, the seating means seats the lid in a lowered position such that the peripheral seal is positioned above the access port which blocks the air-passageway to substantially form a vacuum seal.

An advantage of the present invention is that the vacuum seal container is self-sealing when a predetermined pressure difference is reached between the inside and outside of the container.

Another advantage of the present invention is that the seals are not engaged by a twisting motion of the lid onto the container body, but rather, by a lowering of the lid onto the container body, which preserves the seals and prevents a breakdown of the vacuum seal.

Other advantages of the present invention will become apparent in view of the following detailed description and accompanying drawings.

DETAILED DESCRIPTION OF THE PREFERRED EMBODIMENT

Figure 1:
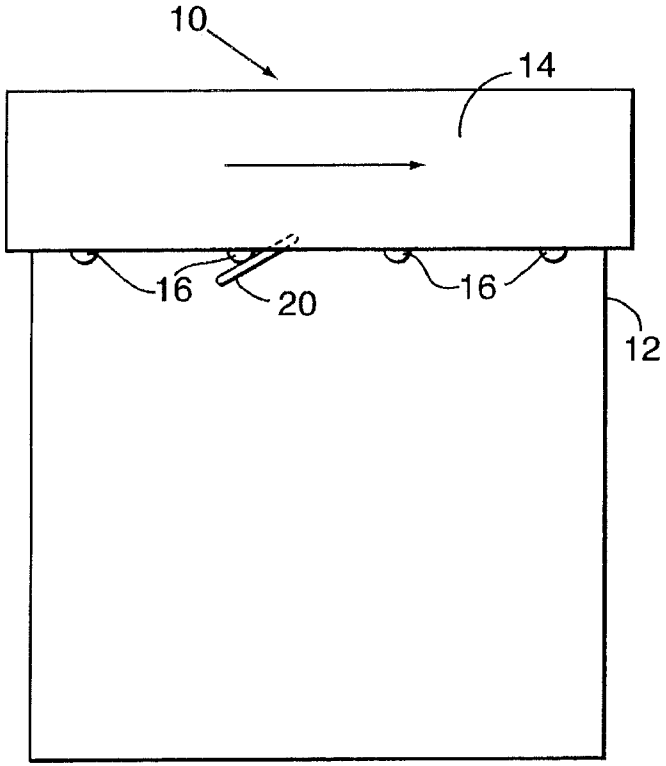
FIG. 1 is a schematic side elevational view of a vacuum seal container embodying the present invention showing means for breaking the vacuum seal.
Figure 4:
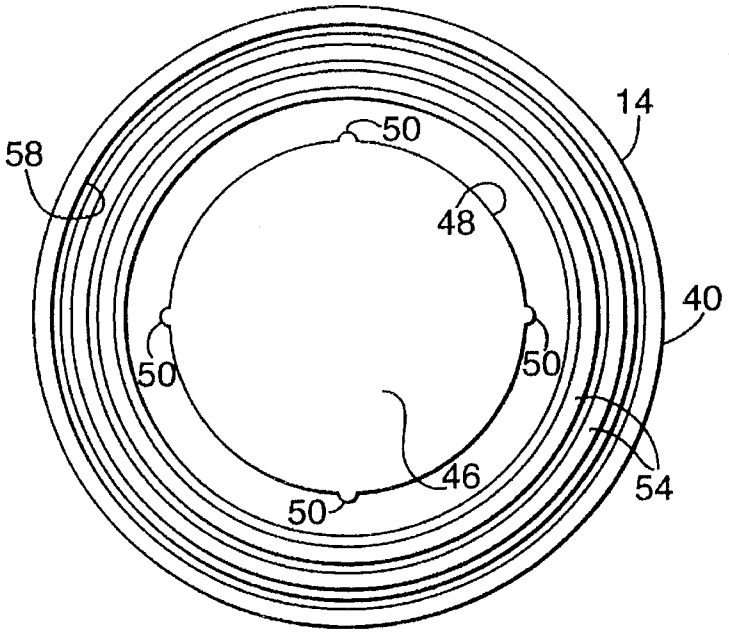
FIG. 4 is a schematic bottom plan view of the container lid in accordance with the present invention.

In FIGS. 1–4, a vacuum-seal container embodying the present invention is generally designated by the reference numeral 10. Referring first to FIG. 1, the container is preferably of a generally cylindrical shape and made from a slightly flexible material such as a hard plastic. The container comprises a container body 12 and a container lid 14. A plurality of unsealing nodes 16, 16 are spaced circumaxially around the container and extend downwardly from a lower edge 18 of the skirt. The nodes ride upwardly on a ramped protrusion 20 formed on an outer surface of the container body adjacent to the lower edge of the skirt to lift the lid and to break the vacuum seal when the lid is twisted in a counterclockwise direction as shown by the arrow in FIG. 1.

Figure 2:
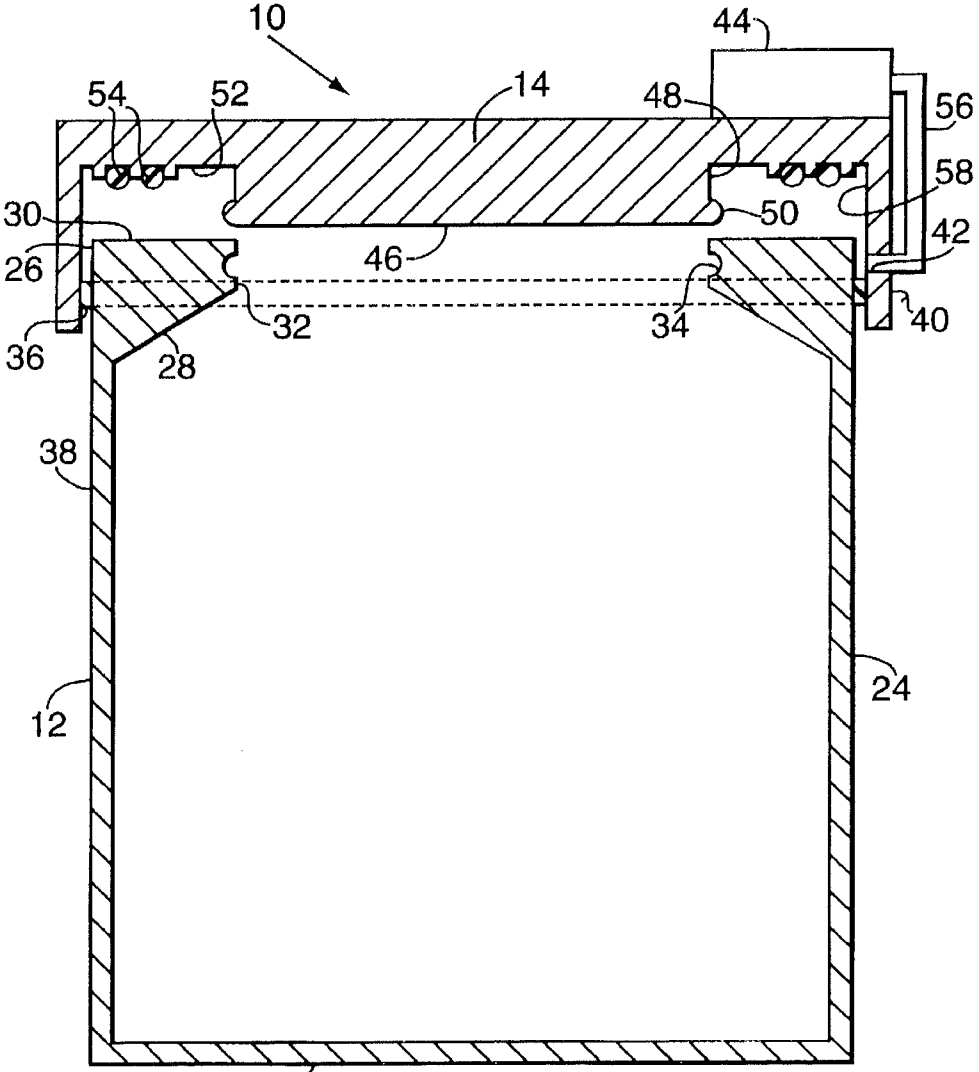
FIG. 2 is a schematic cross-sectional side elevation view of the vacuum seal container of FIG. 1 taken along the central plane of the container and showing the lid in a partially seated or raised position.

FIG. 2 is a cross-sectional view of the container of FIG. 1 taken along the central plane. The container body defines a base 22 and at least one sidewall 24 extending upwardly therefrom and terminating at an upper end 26. The width of the sidewall increases near its upper end to form an enlarged inwardly projecting sidewall portion 28 defining an upper lip surface 30 and an inwardly facing body surface 32. The inner surface of the enlarged sidewall portion defines a groove 34 extending circumaxially around the inner periphery of the enlarged sidewall portion, the purpose of which will be explained below. A peripheral or primary seal 36 extends circumaxially around an outer body surface 38 of the sidewall 24 and is positioned slightly downwardly from the upper end of the sidewall.

The container lid includes a downwardly depending peripheral skirt 40 for engaging the primary seal. The skirt defines an access port 42 for externally communicating with a means for evacuating air from within the container, such as, for example, an electric or manually-operated air pump 44. The lid further defines a central and downwardly depending projection 46 having an outwardly facing projection surface 48 to generally oppose the body surface 32 of the container sidewall. The projection surface 48 of the lid is spaced slightly inwardly from the body surface 32 for forming a space to permit air to be evacuated from within the container, as will be explained below. A plurality of protrusions or seating nodes 50, 50 (preferably four nodes as shown more fully in FIG. 4) extend outwardly from and are disposed circumaxially around the projection surface of the lid. A downwardly facing recessed surface 52 is formed by the lid and surrounds its central projection. One or more annular or secondary seals can be supported on either the recessed surface of the lid or on the lip surface of the container body, and serve as redundant seals to maintain container vacuum if the primary seal should fail.

As shown in the vacuum container of the present invention as illustrated, secondary seals 54, 54 are supported on the recessed surface of the lid, as opposed to on the lip surface of the sidewall, to avoid spilling contents on the seals and thereby forming a poor seal when filling the container. The seals are preferably made of a resilient material, such as, for example, flexible plastics or latex rubber, and are removable and replaceable for maintenance over time and repeated use.

The vacuum pump 44 does not necessarily comprise part of the invention, but is nevertheless schematically shown, as being optionally supported on the container lid. The access port 42 communicates with the air pump via a conduit or hose 56. Preferably the vacuum pump is manually-operated to minimize manufacturing costs.

The operation of the vacuum seal container 10 will now be explained with reference to FIGS. 2 and 3. Turning first to FIG. 2, the lid 14 is placed on the container body 12 such that the seating nodes 50, 50 rest on the lip surface 30 of the container body sidewall to prevent the opposing surfaces 32 and 48 from vertically overlapping, whereby the lid is in a partially-seated or slightly raised position. Thus, the seating nodes 50, 50 function as a resisting means for impeding the movement of the container lid and body relative to one another from the raised position to the lowered position. In the raised position, the secondary seals 54, 54 supported on the lid are raised over and thereby disengaged with respect to the lip surface of the container body. Moreover, the access port 42 is positioned above the peripheral seal 36 such that an air passageway from the access port to the interior of the container is formed for evacuating air from within. The passageway is defined by the space between an inner skirt surface 58 and the outer body surface 38 above the peripheral seal, a cavity formed among the recessed surface 52 and the disengaged secondary seals 54, 54 of the lid and the lip surface 30, and the space formed between the projection surface 48 and the opposing body surface 32 of the sidewall.

The air pump 44, is then actuated to remove air or other gasses from the interior of the container via the above-mentioned air passageway, thus building-up a pressure difference between the interior and exterior of the container. The primary seal 36 blocks air situated below the seal from entering the container and equalizing the pressure between the inside and outside of the container during the evacuation process. When the pressure difference reaches a predetermined threshold level, the atmospheric pressure bearing down on the lid causes the nodes 50, 50 and the enlarged sidewall portion 28 respectively to deform inwardly and outwardly. As such, the opposing surfaces 32 and 48 vertically overlap one another, and nodes 50, 50 snap downwardly into the groove 34 thus moving the lid 14 downwardly to a fully-seated or lowered position and engaging the secondary seals 54, 54 against the lip surface 30 of the container body, as shown in FIG. 3. This downward motion of the lid and the atmospheric pressure pushing against the primary seal strengthen the connection between the primary seal and the lid.

Figure 3:
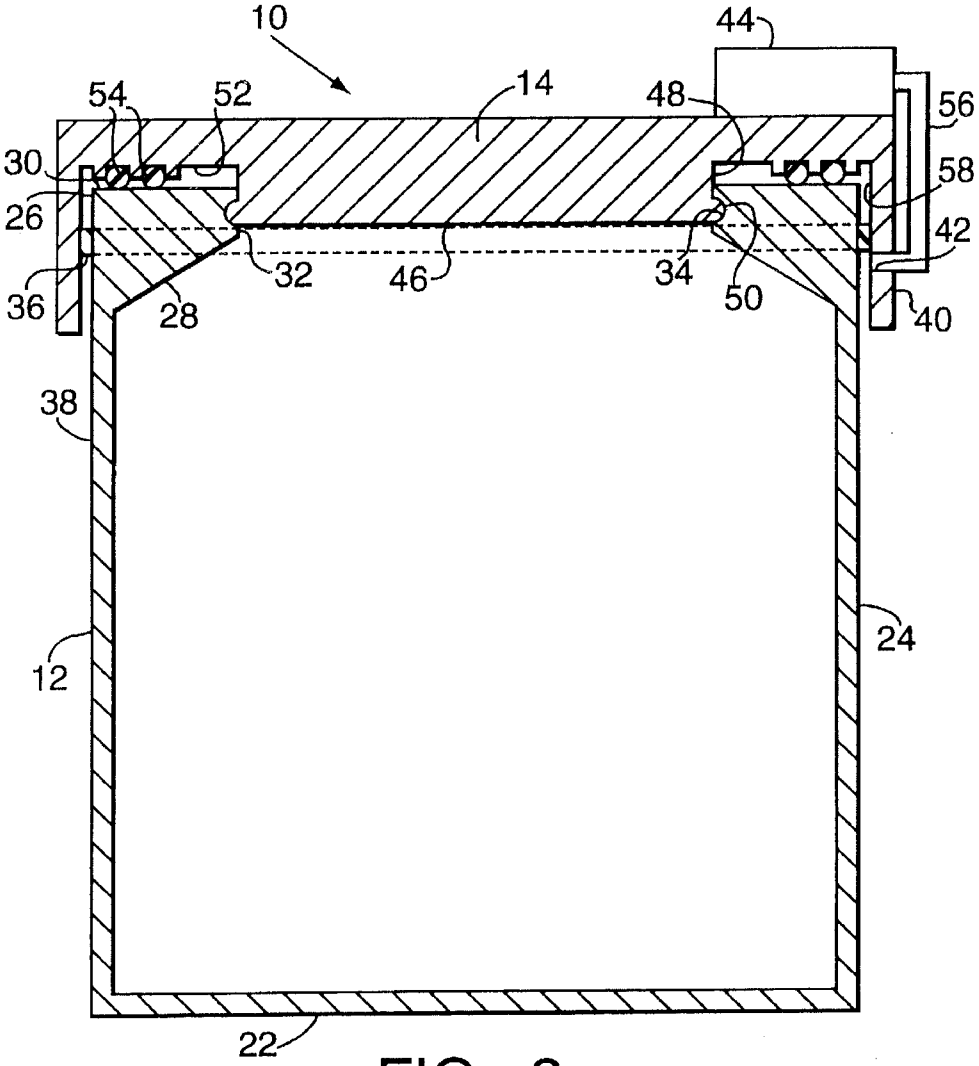
FIG. 3 is a cross-sectional side elevation view of the container as in FIG. 2, and shows the lid in a fully-seated or lowered position.

With reference to FIG. 3, the access port 42 of the skirt 40 of the container lid in the lowered position is now situated below the peripheral or primary seal 36, whereby the peripheral seal blocks the air passageway from the access port to the interior of the container to establish a vacuum seal. Moreover, the secondary seals 54, 54 supported on the recessed surface have moved downwardly with the lid to engage the lip surface 30 to add a level of redundancy in blocking the above-described air passageway. The primary and secondary seals, as shown, thus provide three levels of sealing protection. For example, if the primary seal fails, the outer secondary seal becomes the "primary seal", and if the outer secondary seal also fails, the inner secondary seal becomes the "primary seal".

As will be recognized by those of ordinary skill in the pertinent art, numerous modifications and substitutions may be made to the above-described and other embodiments of the present invention without departing from the scope of the invention as set forth in the appended claims. For example, the nodes may be supported on the outer container body surface, or may be substituted by another suitably shaped protrusion. Furthermore, the container may be provided without the groove for receiving the seating nodes such that the nodes in the lowered lid position are sandwiched tightly between the projection surface and the inwardly facing body surface. Accordingly, the preceding portion of this specification is to be taken in an illustrative sense, as opposed to a limiting sense.

What is claimed is:

1. A vacuum seal container comprising:

a container body defining an outer body surface;

a peripheral seal supported on the outer surface of the container body;

a container lid including a downwardly depending skirt having an inner skirt surface for engaging the peripheral seal, the inner skirt surface to oppose and to be spaced slightly outwardly from the outer body surface such that the inner and outer surfaces define a space therebetween, the skirt further defining an access port for externally communicating with a means for evacuating air from the interior of the container body; and means for seating the lid on the container body in a raised and a lowered position, the seating means to seat the lid in a raised position being such that the access port is positioned above the peripheral seal when the pressure difference between the interior and exterior of the container is below a threshold level, the access port and the space between the outer body surface and the inner skirt surface forming an air passageway to the interior of the container body for evacuating air from within, and the seating means to seat the lid in a lowered position being such that the peripheral seal is positioned above the access port when the pressure difference reaches the threshold level, the peripheral seal blocking the air-passageway between the access port and the interior of the container body so as to substantially form a vacuum seal.

2. A vacuum seal container as defined in claim 1, wherein the seating means comprises resisting means for impeding movement of the container lid and body relative to one another from the raised position to the lowered position.

3. A vacuum seal container as defined in claim 1, wherein the lid defines a centrally-located and downwardly depending projection having an outwardly facing projection surface, and the container body defines an inwardly facing body surface, the outwardly facing projection and inwardly facing body surfaces to generally oppose one another, and wherein the seating means includes a plurality of seating nodes spaced periodically about the periphery of and projecting from one of the opposing surfaces, the nodes to resist overlapping of the opposing surfaces when the pressure difference is below the threshold level, whereby the lid is seated in the raised position, and the nodes and the opposing surfaces being locally deformed when the pressure difference reaches the threshold level such that the opposing surfaces vertically overlap one another, whereby the lid is seated in the lowered position.

4. A vacuum seal container as defined in claim 3, wherein the nodes extend outwardly from the projection surface of the lid projection.

5. A vacuum seal container as defined in claim 4, wherein the inwardly facing body surface includes a groove extending around its inner periphery, the groove receiving the plurality of seating nodes when the lid is seated in the lowered position.

6. A vacuum-sealed container as defined in claim 3, wherein the lid defines an inner recessed surface surrounding the projection, and the container body defines an upper lip surface to oppose the inner recessed surface; and further comprising at least one secondary seal extending around the periphery of the projection, and supported on one of the opposing recessed and lip surfaces, the secondary seal to engage the opposing recessed and lip surfaces when the lid is in the lowered position.

7. A vacuum seal container as defined in claim 6, wherein the secondary seal is supported on the recessed surface of the lid.

8. A vacuum-sealed container as defined in claim 1, further including a means for evacuating air from within the container body, the evacuating means being coupled to the lid.

9. A vacuum-sealed container as defined in claim 1, wherein the container is cylindrical; and further includes a plurality of unsealing nodes spaced circumaxially around the container and projecting downwardly from a lower edge of the skirt, and a ramped projection extending outwardly from the outer body surface of the container body adjacent the lower end of the skirt, the unsealing nodes to ride upwardly on the ramp when the lid is twisted to lift the lid and break the vacuum.

* * * * *